US009217214B2

(12) United States Patent
Ross et al.

(10) Patent No.: US 9,217,214 B2
(45) Date of Patent: Dec. 22, 2015

(54) SYSTEMS AND METHODS OF DRAWSTRING RESTRINGING AND RECOVERY

(75) Inventors: Noel Ross, Chicago, IL (US); Frank Grad, Chicago, IL (US)

(73) Assignee: INNOVATORS INC, Chicago, IL (US)

( * ) Notice: Subject to any disclaimer, the term of this patent is extended or adjusted under 35 U.S.C. 154(b) by 536 days.

(21) Appl. No.: 12/770,100

(22) Filed: Apr. 29, 2010
(Under 37 CFR 1.47)

(65) Prior Publication Data

US 2011/0101042 A1 May 5, 2011

Related U.S. Application Data

(60) Provisional application No. 61/174,077, filed on Apr. 30, 2009.

(51) Int. Cl.
*D05B 91/02* (2006.01)
*D04D 11/00* (2006.01)

(52) U.S. Cl.
CPC ..... *D05B 91/02* (2013.01); *D04D 11/00* (2013.01)

(58) Field of Classification Search
CPC ..... D04D 11/00; D05B 91/02
USPC ..... 223/48, 50, 99, 102, 103, 104, 105; 24/128, 129 R, 130, 129 B, 116 A
See application file for complete search history.

(56) References Cited

U.S. PATENT DOCUMENTS 299,305 A * 5/1884 Weed ..... 57/23
342,850 A * 6/1886 Smith ..... 403/56
535,108 A * 3/1895 Helgesson ..... 57/23

(Continued)

FOREIGN PATENT DOCUMENTS

JP 2001-131851 A 5/2001
JP 2001131851 * 5/2001

(Continued)

OTHER PUBLICATIONS

Definition of "leading edge," oxforddictionaries.com Feb. 19, 2015.*

(Continued)

*Primary Examiner* — Shaun R Hurley
*Assistant Examiner* — Andrew W Sutton
(74) *Attorney, Agent, or Firm* — Lisa Foundation Patent Law Clinic at Arizona State University

(57) ABSTRACT

A drawstring recovery and restringing device that includes a leading edge, a flexible cylindrical mid-portion and a grab scoop member. The device may be used in various methods of restringing drawstrings through articles having a drawstring channel, including securing a drawstring end within the device's grab scoop member, inserting the leading edge of the device into a drawstring channel of an article, pushing the device through the drawstring channel until the leading edge protrudes from the other end of the drawstring channel and pulling the leading edge of the device until the entire device exits the drawstring channel. The device may also be used to recover a drawstring that is fully enclosed in a drawstring channel, by feeding the grab scoop member of the device into the drawstring channel, placing the drawstring within the grab scoop member, and pulling the leading edge of the device through the drawstring channel.

7 Claims, 10 Drawing Sheets

(56) References Cited

U.S. PATENT DOCUMENTS

| | | | | | |
|---|---|---|---|---|---|
| 838,973 | A | * | 12/1906 | Freeze | 223/103 |
| 1,012,768 | A | * | 12/1911 | Vogelmann | 223/102 |
| 1,119,659 | A | | 12/1914 | Steiner et al. | |
| 1,161,448 | A | | 11/1915 | Boye | |
| 1,195,513 | A | * | 8/1916 | Seymoure | 24/130 |
| 1,374,710 | A | | 4/1921 | Antanaviczius | |
| 1,887,066 | A | * | 11/1932 | Patchen | 24/102 R |
| 1,943,174 | A | * | 1/1934 | Gagnon | 223/102 |
| 2,036,172 | A | * | 3/1936 | Gagnon | 24/116 A |
| 2,319,442 | A | * | 5/1943 | Carlson | 112/80.05 |
| 2,442,472 | A | * | 6/1948 | Sagan | 224/103 |
| 2,491,776 | A | * | 12/1949 | Skelton | 223/102 |
| 2,563,533 | A | * | 8/1951 | Knox | 119/805 |
| 2,574,579 | A | * | 11/1951 | McCoy et al. | 403/315 |
| 2,705,098 | A | * | 3/1955 | Sipler, Jr. | 223/102 |
| 2,763,410 | A | * | 9/1956 | Walker | 223/103 |
| 2,893,089 | A | * | 7/1959 | Bacon | 24/116 A |
| D206,855 | S | * | 2/1967 | Feria | D3/28 |
| 4,128,920 | A | * | 12/1978 | Bourguignon | 24/303 |
| D252,478 | S | | 7/1979 | Grimes | |
| 4,377,078 | A | * | 3/1983 | Block | 63/3.1 |
| 4,432,120 | A | * | 2/1984 | Sherman et al. | 24/299 |
| 4,671,437 | A | * | 6/1987 | Sauger | 223/103 |
| 4,863,079 | A | | 9/1989 | Holmgren | |
| 4,928,634 | A | * | 5/1990 | Voigt | 119/805 |
| 5,219,624 | A | * | 6/1993 | Kiapos et al. | 428/28 |
| 5,353,972 | A | | 10/1994 | Mandel | |
| 5,447,260 | A | * | 9/1995 | Beddow | 223/50 |
| 5,524,800 | A | * | 6/1996 | Arney | 223/50 |
| 5,615,454 | A | * | 4/1997 | Contarino | 24/3.13 |
| 5,704,066 | A | * | 1/1998 | Yamamoto | 2/161.6 |
| 5,785,215 | A | * | 7/1998 | Hinkel | 223/50 |
| D405,251 | S | * | 2/1999 | Nazemi | D3/18 |
| 6,349,568 | B1 | * | 2/2002 | Ito | 63/3 |
| 6,434,800 | B1 | * | 8/2002 | James et al. | 24/298 |
| 7,073,693 | B2 | | 7/2006 | Law | |
| 7,584,513 | B2 | | 9/2009 | Nguyen | |
| 2011/0101042 | A1 | * | 5/2011 | Ross et al. | 223/50 |

FOREIGN PATENT DOCUMENTS

| | | | | |
|---|---|---|---|---|
| JP | 2005-232651 | A | | 9/2005 |
| JP | 2005232651 | | * | 9/2005 |

OTHER PUBLICATIONS

The Sewing Place; Easy Threader http://thesewingplace.com/browseproducts/Easy-Threader.html.

* cited by examiner

SYSTEMS AND METHODS OF DRAWSTRING RESTRINGING AND RECOVERY

CROSS REFERENCE TO RELATED APPLICATION

This application claims the benefit, under 35 U.S.C. §119 (e) of U.S. Provisional Application No. 61/174,077 filed Apr. 30, 2009, which is incorporated by reference herein in its entirety.

BACKGROUND OF THE INVENTION

1. Field of the Invention

The present invention relates to devices and methods of recovering and restringing drawstrings in articles that include drawstrings.

2. Description of Related Art

Various garments such as pants, shorts, and sweatshirts, exist that include drawstrings. A common problem that exists regarding these garments is that the drawstring is removed or lost from the drawstring channel or that the drawstring becomes fully enclosed in the drawstring channel so that at least one of the ends of the drawstring no longer protrudes from the drawstring channel. Thus, it becomes necessary to recover and/or resting the drawstring through the drawstring channel of the garment.

So as to reduce the complexity and length of the Detailed Specification, and to fully establish the state of the art in certain areas of technology, Applicants herein expressly incorporate by reference all of the following materials identified in each numbered paragraph below.

U.S. Pat. No. 299,305
U.S. Pat. No. 1,119,659
U.S. Pat. No. 2,491,776
U.S. Pat. No. 4,671,437
U.S. Pat. No. 4,863,079
U.S. Pat. No. 5,353,972
U.S. Pat. No. 5,447,260
U.S. Pat. No. 5,524,800
U.S. Pat. No. 5,785,215
U.S. Pat. No. 7,073,693
U.S. Pat. No. 7,584,513
U.S. Design Pat. No. 405,251

For example, U.S. Pat. No. 5,785,215, incorporated above, discloses a drawstring restringing apparatus that requires that one end of the drawstring be tied in a knot while the remaining length of the drawstring is threaded into a hollow channel. The device is then pushed through the drawstring channel to resting the drawstring. This channel of this device is rigid and thus, it is difficult for the user to push the device through a circular drawstring channel. The rigidity of the device also limits the diameter of the drawstring channel that may be accommodated.

Applicants believe that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicants will amend the specification to expressly recite the essential material that is incorporated by reference as allowed by the applicable rules.

BRIEF SUMMARY OF THE INVENTION

The present invention provides among other things stringing, restringing, and recovering devices and methods usable with drawstrings, electrical wires, audio speaker wires, sailboat halyards and sheets, elastic strings, and ropes, which include a leading edge with a cylindrical mid-portion and a split member that may have a cone-like shape. The split member has at least one flexible side that allows the member to fold around any sized drawstring and secure the drawstring within the sides of the member so that the drawstring remains within the sides of the member while the device is pulled through the drawstring channel of an article following the leading edge of the device. The present invention also provides, among other things, methods for restringing drawstrings using the drawstring recovery and restringing device. A drawstring end is secured within the grab scoop member of the device, the leading edge of the device is fed into the drawstring channel of an article, and the device is pulled by the leading edge through the drawstring channel until the entire device exits the drawstring channel. The drawstring may then be removed from the grab scoop member. The present invention further provides methods for drawstring recovery when a drawstring is fully enclosed in the drawstring channel of a garment.

It is an object of the invention to restring a drawstring in a garment or other article that has a drawstring channel. Examples of such articles that have a drawstring channel include, but are not limited to sweatpants, hooded sweatshirts, cargo pants, shorts, pajamas, medical scrubs, athletic gear, camping gear such as sleeping bags and tents, duffle bags, military gear, automotive gear such as buffer pads, covers for various objects, and tarps.

It is another object of the invention to recover a drawstring that is fully enclosed in the drawstring channel of a garment or other article.

It is another object of the invention to make drawstring recovery and restringing faster and easier by using a flexible device that may be more easily fed through the drawstring channel of a garment or other article.

It is another object of the invention to simplify the drawstring recovery and restringing device by having the device be comprised of only one piece.

It is another object of the invention to recover and restring drawstrings by pulling the drawstring recovery and restringing device through the drawstring channel rather than pushing the device through the channel.

It is another object of the invention to provide adequate flexibility in the device so that the device will fit through various sized holes leading into the drawstring channel of a garment or other article, including grommets.

It is another object of the invention to provide a universal device for use with all sizes and types of drawstrings, including but not limited to flat, wide, knotted, or taped drawstrings.

It is another object of the invention to secure a drawstring to the device without the use of tape or glue or the need to knot the drawstring to the device.

It is another object of the invention for the grab scoop of the device to be self-adjusting and tighten around the drawstring to secure the drawstring within the grab scoop while creating a minimal addition to the circumference of the drawstring.

It is another object of the invention to easily restring or recover drawstrings from drawstring channels of various lengths, including but not limited to bottoms of garment sleeves or pant or short legs, waistbands, garment hoods, camping gear such as tents or sleeping bags, duffle bags, military gear, automotive equipment such as buffer pads, and tarps or other covers for items.

It is another object of the invention to string or restring audio wiring through audio devices such as speaker boxes or to recover such wiring if the wiring becomes fully enclosed within a device such that at least one end of the wiring fails to protrude from the device.

It is another object of the invention to string or restring wires or other material through conduits such as electrical conduits used in residential and commercial building construction, pipes, channels in automobiles, airplanes, boats, and other vehicles, channels in trailers or automobile or other vehicle frames.

It is another object of the invention to string or restring halyards or other sheets on sailboat masts or other points of rigging on sailboats.

The above and other objects may be achieved using devices involving a leading edge, a flexible cylindrical mid portion and a grab scoop member. The leading edge of the device may be rounded, and may also comprise a slit that protrudes from the leading edge. The grab scoop member of the device may be comprised of a flexible material, may have at least one flexible side, and may have a split cone-like shape.

The above and other objects may be achieved using attachable elements that couple to the leading edge of the drawstring restringing device. These attachable elements may be comprised of a functional end and a hollow end with a slit that is configured to hold the protruding slit on the leading edge. The functional end may be comprised of a magnet or a hooking device.

The above and other objects may be achieved using a hooking element or a magnetic element that couples to the grab scoop member. The hooking or magnetic element may comprise a rounded leading edge and a hooking or magnetic member, respectively.

The above and other objects may be achieved using a drawstring restringing device that has a separable grab scoop member that is configured to be coupled to the flexible mid portion. The separable grab scoop member may be comprised of a tension clamp, a flexible material, split-cone like shaped member, a flexible material, a hooking element, or a magnetic element.

The above and other objects may be achieved using a drawstring restringing devices with a separable leading edge piece that is configured to be coupled to the flexible mid portion. The separable leading edge piece may be rounded and may comprise a slit that protrudes from the leading edge.

The above and other objects may be achieved using a restringing device that comprises a leading edge, a flexible mid portion, and a hinged clamp. The hinged clamp may comprise a flexible crease, teeth-like protrusions, and a locking mechanism configured to hold the hinged clamp closed.

The above and other objects may be achieved using methods involving using a drawstring recovery and restringing device to secure a drawstring end within a grab scoop member, insert a leading edge into a drawstring channel of an article, push the device through the drawstring channel until the leading edge protrudes from the other end of the drawstring channel; and pull the leading edge of the device until the entire device exits the drawstring channel. The methods may further comprise removing the drawstring from the grab scoop member. The methods may further comprise wherein the grab scoop member has a split cone-like shape. The methods may further comprise wherein the drawstring end is secured within the grab scoop member by placing the drawstring end over the split of the grab scoop member and then pulling the drawstring end down and toward the narrow end of the grab scoop member. The above and other objects may also be achieved by methods involving using a drawstring recovery device to feed a grab scoop member into the drawstring channel, place the drawstring within the grab scoop member, and pull a leading edge of the device through the drawstring channel. The methods may further comprise removing the drawstring from the grab scoop member. The methods may further comprise wherein the grab scoop member has a split cone-like shape. The methods may further comprise wherein the drawstring end is secured within the grab scoop member of the device by placing the drawstring end over the split of the grab scoop member and then pulling the drawstring end down and toward the narrow end of the grab scoop member. The methods may further comprise securing the rounded leading edge of a second drawstring restringing device within the grab scoop member of the first drawstring restringing device by placing a mid portion over the split of the grab scoop member of the first drawstring restringing device and then pulling the second drawstring restringing device down and toward the narrow end of the grab scoop member of the first drawstring restringing device.

The above and other objects may be achieved using methods involving using a drawstring recovery and restringing device to secure a drawstring end within a hinged clamp member, insert a leading edge into a drawstring channel of an article, push the device through the drawstring channel until the leading edge protrudes from the other end of the drawstring channel; and pull the leading edge of the device until the entire device exits the drawstring channel.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
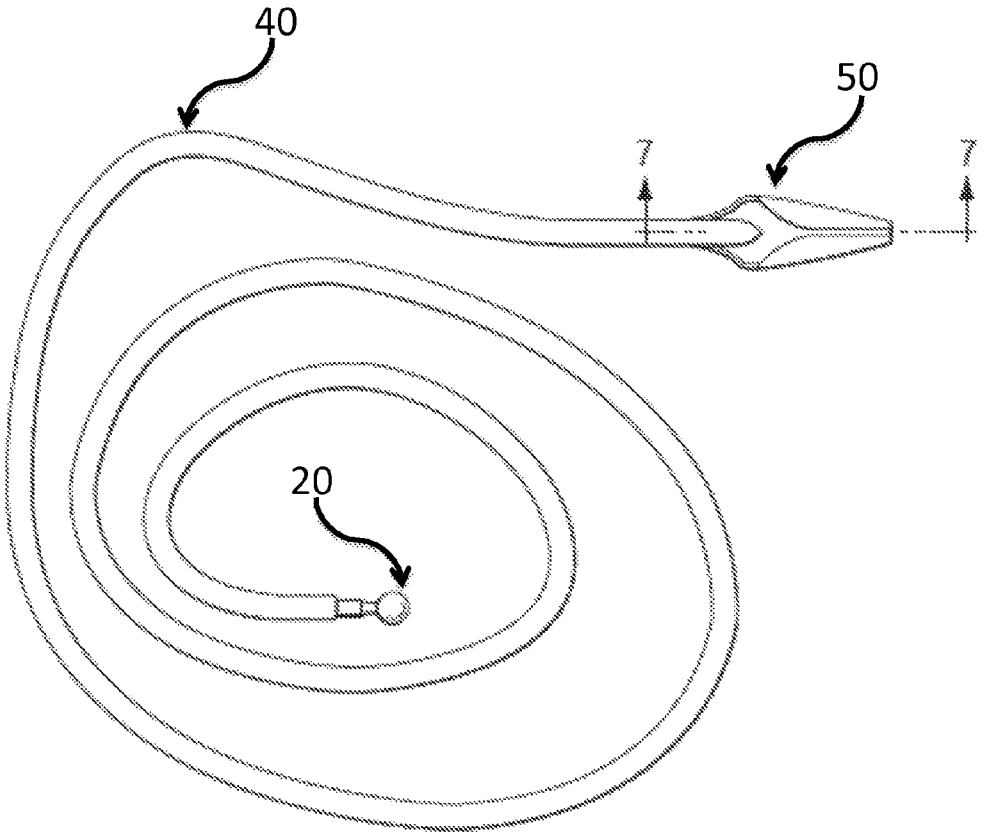
FIG. 1 depicts a drawstring recovery and restringing device comprising a leading edge, a flexible cylindrical mid-portion, and a grab scoop member.
Figure 2:
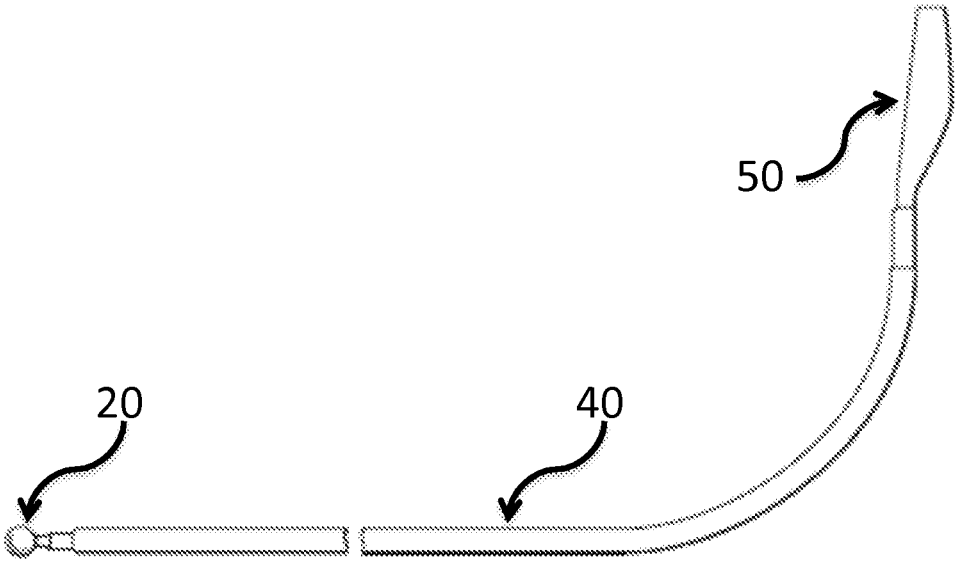
FIG. 2 depicts a side profile of a drawstring recovery and restringing device comprising a leading edge, a flexible cylindrical mid-portion, and a grab scoop member.
Figure 3:
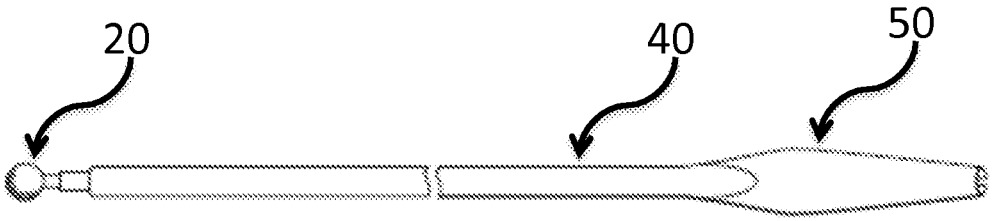
FIG. 3 depicts a bottom profile of a drawstring recovery and restringing device comprising a leading edge, a flexible cylindrical mid-portion, and a grab scoop member.

Referring now to FIGS. 1-3, a device according to various aspects of the present invention is shown. In the shown embodiment, the drawstring restringing device comprises a rounded leading edge 20, a flexible mid-portion 40, and split cone-like shaped grab scoop member 50. In one application of the invention, the drawstring recovery and restringing device is comprised of a leading edge, a flexible mid-portion and a grab scoop member. In a preferred embodiment shown in FIG. 1, the mid-portion 40 is cylindrical, the leading edge 20 has a rounded shape and the grab scoop member 50 is comprised of a flexible material and has a split cone-like shape. In this application of the invention, the device may be comprised of one piece.

In a preferred embodiment of the invention, the length of the flexible cylindrical mid portion 40 of the device may be comprised of materials such as flexible 16 gauge electrical wire having an alligator or other clip or clamp utilizing tension, 18 gauge copper wire, plastic or other synthetic wire, or extruded hose made of rubber, plastic, metal tubing, or other materials. In a preferred embodiment, the flexible cylindrical mid portion 40 may also be comprised of aluminum, brass, steel, or other cable comprised of other materials. In a preferred embodiment, the flexible cylindrical mid portion 40 may be comprised of a material having a flexibility of approximately 90 durometers. The length of the cylindrical mid portion 40 can be customized to different lengths, such as, but not limited to 10 inches, 20 inches, or 40 inches depending on the length of the drawstring channel or for industrial use, a longer cylindrical mid portion such as 250 feet may be preferable for use in other types of channels.

An application of the invention may be manufactured such that the device is comprised of three separate components having attachable or changeable ends. The ends of the components may be attached to one another by screwing or snapping the components together or the components may be attached by a frictional or tensional fit. Changeable ends of the components may include hooks, loops, magnets, or directional teeth that grip such as for example, a metal grab scoop member with directional gripping teeth.

Figure 4A:
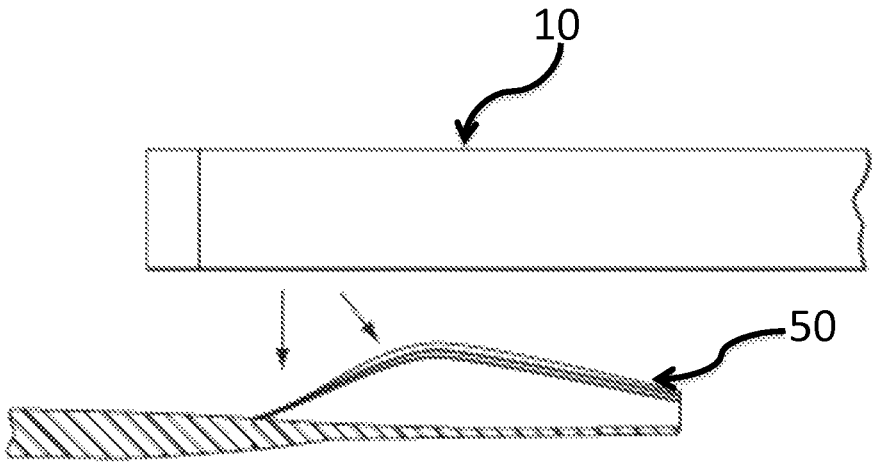
FIG. 4A-C depicts a cross-sectional view of the grab scoop member and insertion of the drawstring in the grab scoop member.
Figure 4B:
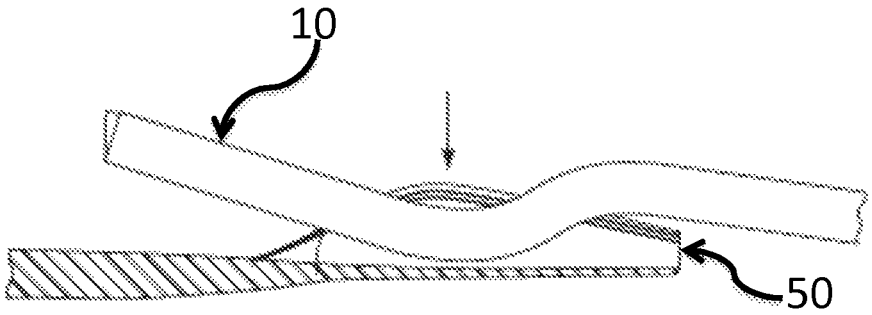
Figure 4C:
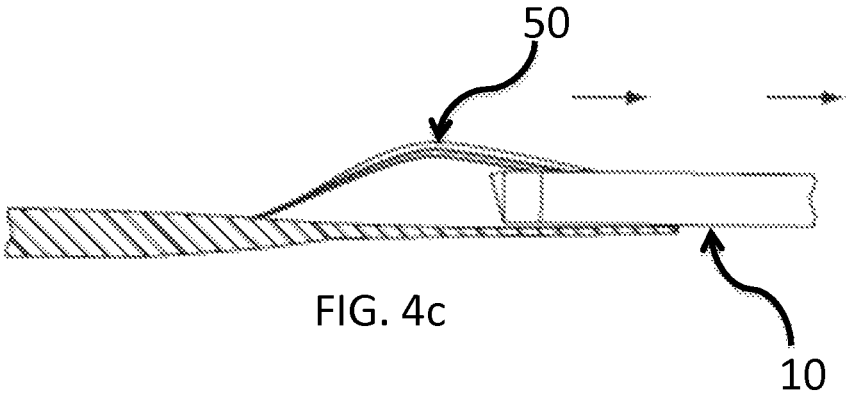

Referring now to FIGS. 4*a*-4*c*, where a cross-sectioned view of securing of a drawstring 10 within a split cone-like shaped grab scoop member 50 is shown. FIG. 4*a* shows the drawstring 10 outside the split grab scoop member 50. FIG. 4*b* shows the placement of the drawstring 10 through the split in the grab scoop member 50. FIG. 4*c* shows the final securing of the drawstring 10 within the grab scoop member 50, after the drawstring 10 has been pulled towards the bottom of the cone-like grab scoop member 50. In an application of the invention, the drawstring recovery and restringing device is used to restring a drawstring into the drawstring channel of a garment by securing a drawstring end within the grab scoop member 50, inserting the leading edge 20 of the device into the drawstring channel of an article, pushing the device through the drawstring channel until the leading edge 20 protrudes from the other end of the drawstring channel and pulling the leading edge 20 of the device until the entire device exits the drawstring channel. The drawstring may then be removed from the grab scoop member 50. In an embodiment featuring a grab scoop member 50 that utilizes a split cone, the drawstring may require a knot to prevent the drawstring from slipping through the grab scoop member. In one embodiment, the drawstring end may be secured within the grab scoop member 50 by placing the drawstring end over the split of the grab scoop member 50 and then pulling the drawstring end down and toward the narrow end of the grab scoop member 50.

Figure 5A:
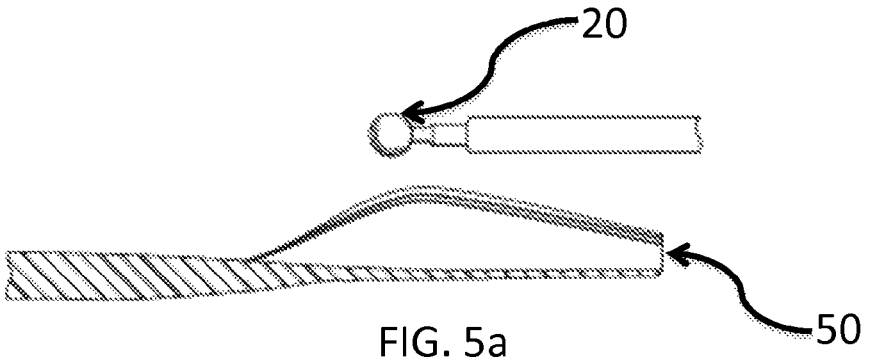
FIG. 5A-C depicts a cross-sectional view of the grab scoop member and insertion of a leading edge in the grab scoop member.
Figure 5B:
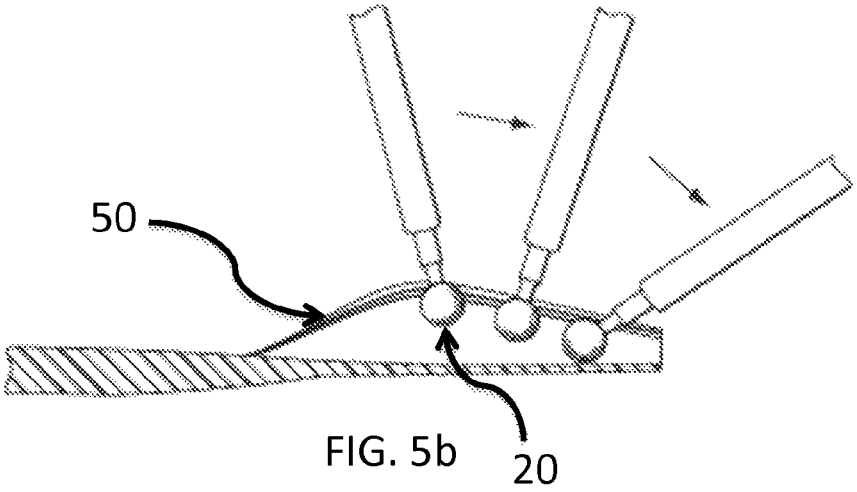
Figure 5C:
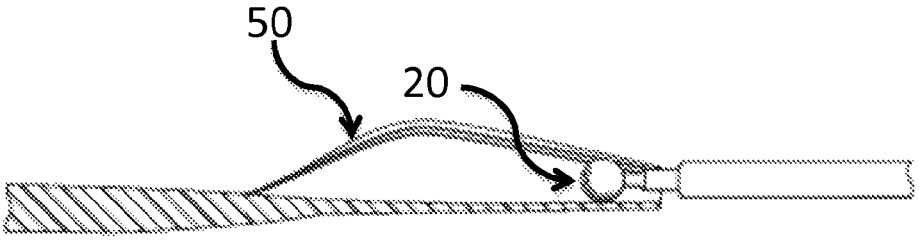

Referring now to FIGS. 5*a*-5*c*, where a cross-section view of securing a rounded leading edge 20 within a split cone-like shaped scoop member 50 is shown. In an application of the invention, the device may be manufactured such that each component of the device has connecting ends so that the length of each existing component may be extended by attaching additional components. One application of the invention may be manufactured such that the leading edge 20 of the device fits within the grab scoop member 50 and locks into place after pulling the mid portion 40 down toward the narrow end of the grab scoop member 50. This allows two or more restringing devices to be attached together. Another application of the invention may be manufactured such that the leading edge 20 of the device has a slit 30 that conforms to the grab scoop member 50 and locks into place. FIG. 5*a* shows the rounded leading edge 20 outside the split grab scoop member 50. FIG. 5*b* shows the place of the rounded leading edge 20 through the split in the grab scoop member 50. FIG. 5*c* shows the final securing of the rounded leading edge 20 within the grab scoop member 50, after the rounded leading edge 20 has been pulled towards the bottom of the cone-like grab scoop member 50.

Figure 6A:
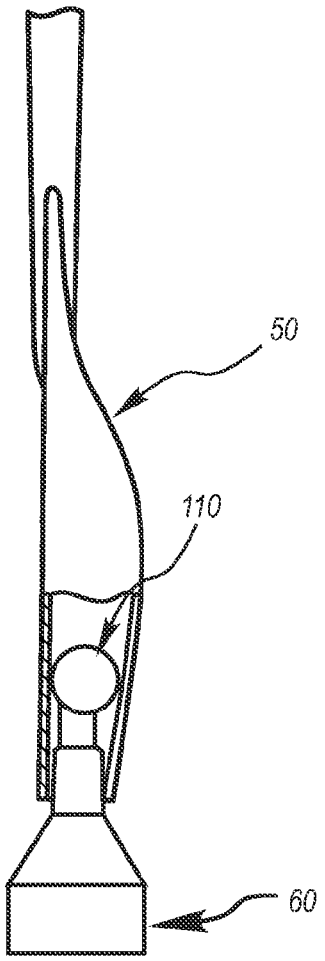
FIG. 6A-B depicts apparatuses that may be coupled to the grab scoop member.
Figure 6B:
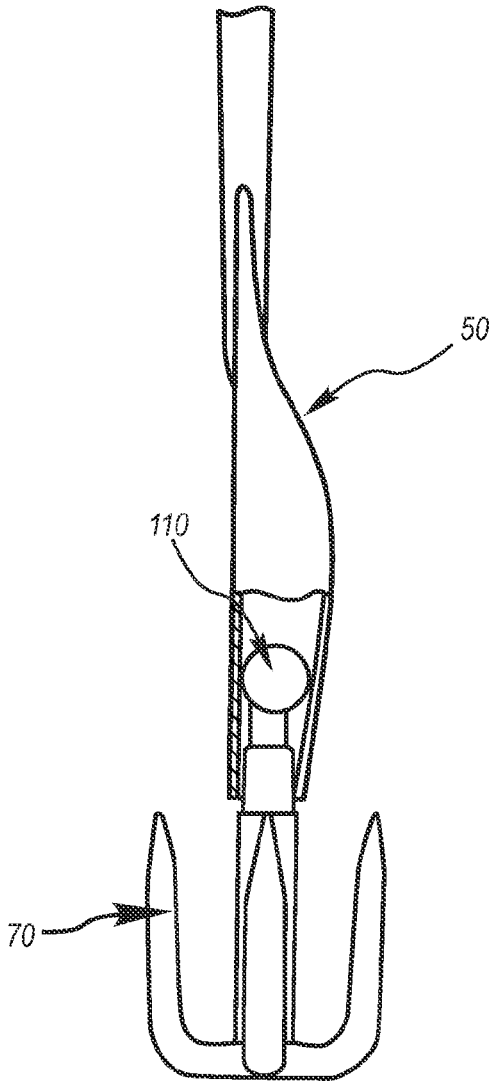

Referring now to FIG. 6*a*-6*b*, where a magnet element 60 and a hooking element 70 are shown secured to the grab scoop member 50. The device according to various aspects of the present invention may also comprise elements that secure to the grab scoop element. The elements that attach to the grab scoop member may comprise a rounded leading edge and any element for coupling, such as a hooking element 70, a magnet element 70, a tension clamp element, a Velcro element, and the like. In the embodiments shown, both the magnet element 60 and the hooking element 70 comprise a rounded leading edge 110 that is secured within the grab scoop member similar to FIG. 4. The element may attach to the split cone-like shaped grab scoop member 50 by fitting the rounded leading edge within the grab scoop member and pulling the apparatus down toward the narrow end of the grab scoop member until the apparatus is locked into place. Another application of the invention may be manufactured such that the rounded edge of the apparatus has a slit that conforms to the grab scoop member 50 and locks into place.

Figure 7:
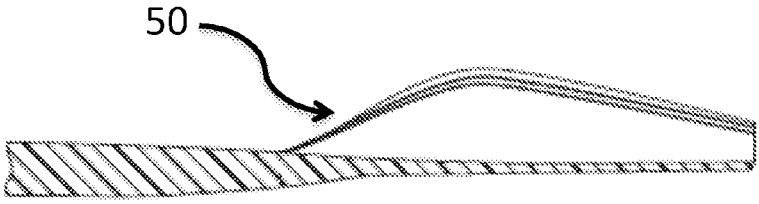
FIG. 7 depicts a cross-sectional view of the grab scoop member.

Referring now to FIG. 7, a cross section of a split cone-like shaped grab scoop member is shown. In the embodiment shown, the grab scoop member comprises a flexible material. In other embodiments of the invention, the grab scoop member 50 may be comprised of plastic, metal having directional teeth, a hook, or a magnet which can also be used to retrieve metal items such as keys, bolts, screws, and bearings.

Figure 8:
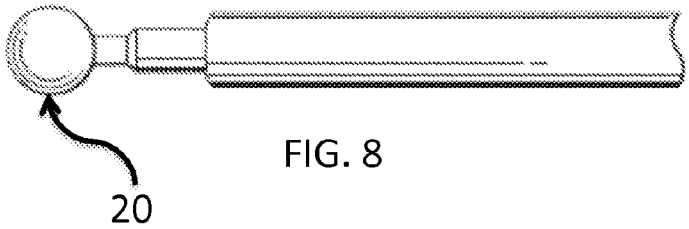
FIG. 8 depicts a rounded leading edge of the grab scoop member.

Referring now to FIG. 8, a rounded leading edge of the drawstring restringing device is shown. In various embodiments, the rounded leading edge may comprise an element for securing the leading edge to another element, such as a slit that protrudes from the rounded leading edge.

Figure 9:
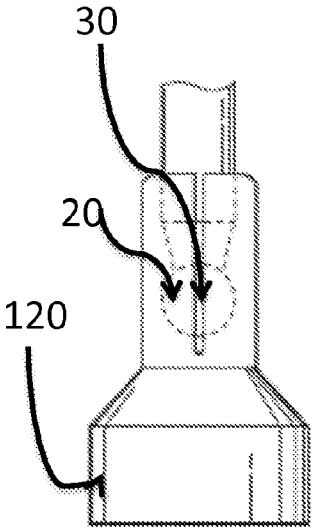
FIG. 9 depicts an attachable element coupled to a rounded leading edge.

Referring now to FIG. 9, an attachable element is shown. In various embodiments, attachable elements may be manufactured to attach to the rounded leading edge 20 of the restringing device. The attachable element may comprise a hollow connecting end with a narrow slit 30 and a functional end. The slit in the hollow connecting end may be configured to attach the protruding slit on the rounded leading edge. The functional end of the attachable element may comprise a hook, magnet 120, clamp, and the like. In the embodiment shown in FIG. 9, the functional end comprises a magnet 120. The hollow end comprises a slit 30 the may be configured to fit a protruding slit on the leading rounded edge 20 of the drawstring restringing device.

Figure 10:
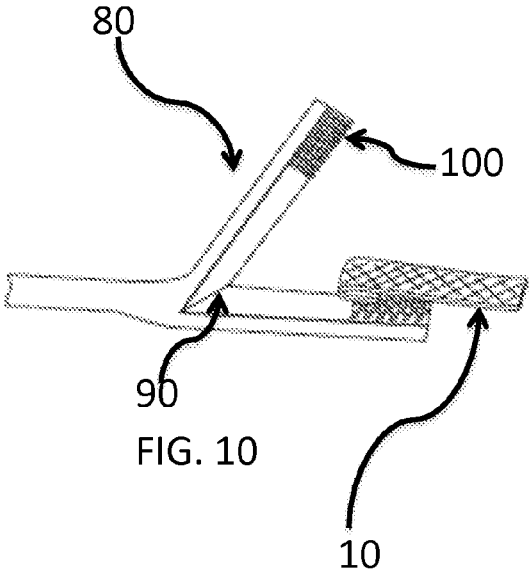
FIG. 10 depicts a hinged clamp drawstring restringing device.

Referring now to FIG. 10, a drawstring restringing device with a hinged clamp element 80 is shown. In another embodiment, the restringing device is comprised of a leading edge, and flexible mid portion 40, and a hinged clamp element 80. The hinged clamp element 80 may comprise any configuration that allows the element 80 to clamp down on a material and hold the material within the clamp as the restringing device is pulled through a drawstring channel. The hinged clamp may be flexible at the crease 100. The hinged clamp 80 may also comprise a locking mechanism with any configuration to hold the clamp closed, such as but not limited to a snap, a button, a latch, a magnet, a hook device, a clasp, and the like. The hinged clamp may further comprise any configuration that allows the clamp to more efficiently hold the material 10 within the grasp of the clamp, such as but not limited to teeth-like protrusions 100, an adhesive surface, an increased friction surface, and the like. As shown in FIG. 10, according to various embodiments, the hinged clamp element 80 may comprise a flexible crease 90 and teeth-like protrusions 100 that securing the drawstring 10 when the clamp is closed.

Similar to the grab scoop configuration of the drawstring restringing device, the hinged clamp embodiment may be used by securing any drawstring material within the hinged clamp element. Securing the drawstring material within the hinged clamp may include placing the drawstring material in the clasp of teeth-like protrusions in the clamp and using a locking mechanism to hold the clamp closed. After the drawstring material is secured in the hinged clamp, a leading edge of the restringing device may be inserted into a drawstring channel of an article. The device may then be pushed through the drawstring channel until the leading edge protrudes from the other end of the drawstring channel. The leading edge may then be pulled until the entire device, including the hinged clamp element exits the drawstring channel.

Figure 11:
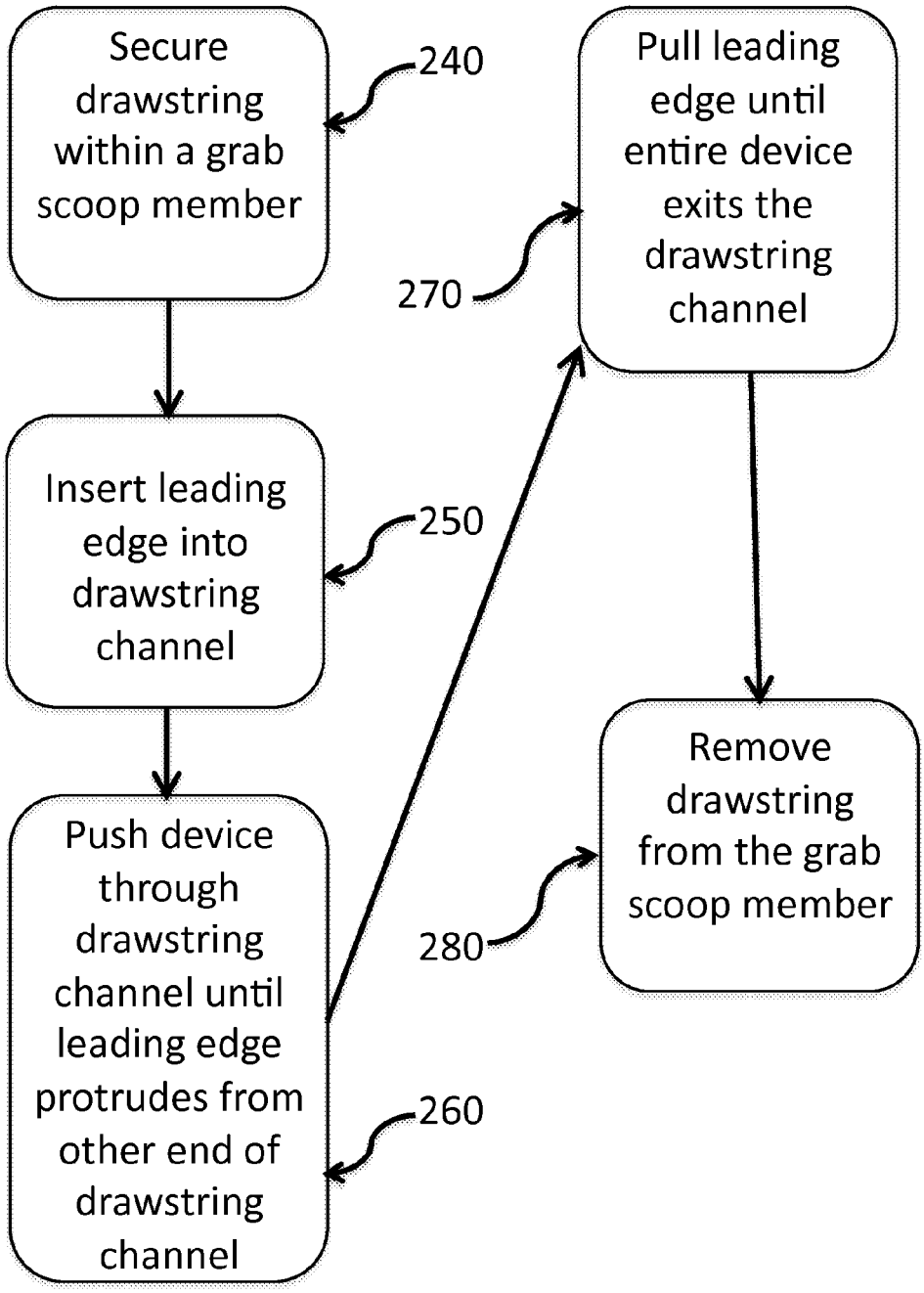
FIGS. 11-12 depict a method for restringing a drawstring using a drawstring restringing device.

Referring now to FIG. 11, a method of restringing a drawstring using a drawstring restringing device is shown. First, a drawstring is secured within a grab scoop member 240. Next, the leading edge is inserted into a drawstring channel 250. The drawstring restringing device is then pushed through the drawstring channel until the leading edge protrudes from the other end of the drawstring channel 260. Next, the leading edge is pulled until the entire device exits the drawstring channel 270. Finally, the drawstring is removed from the grab scoop member 280.

Figure 12:
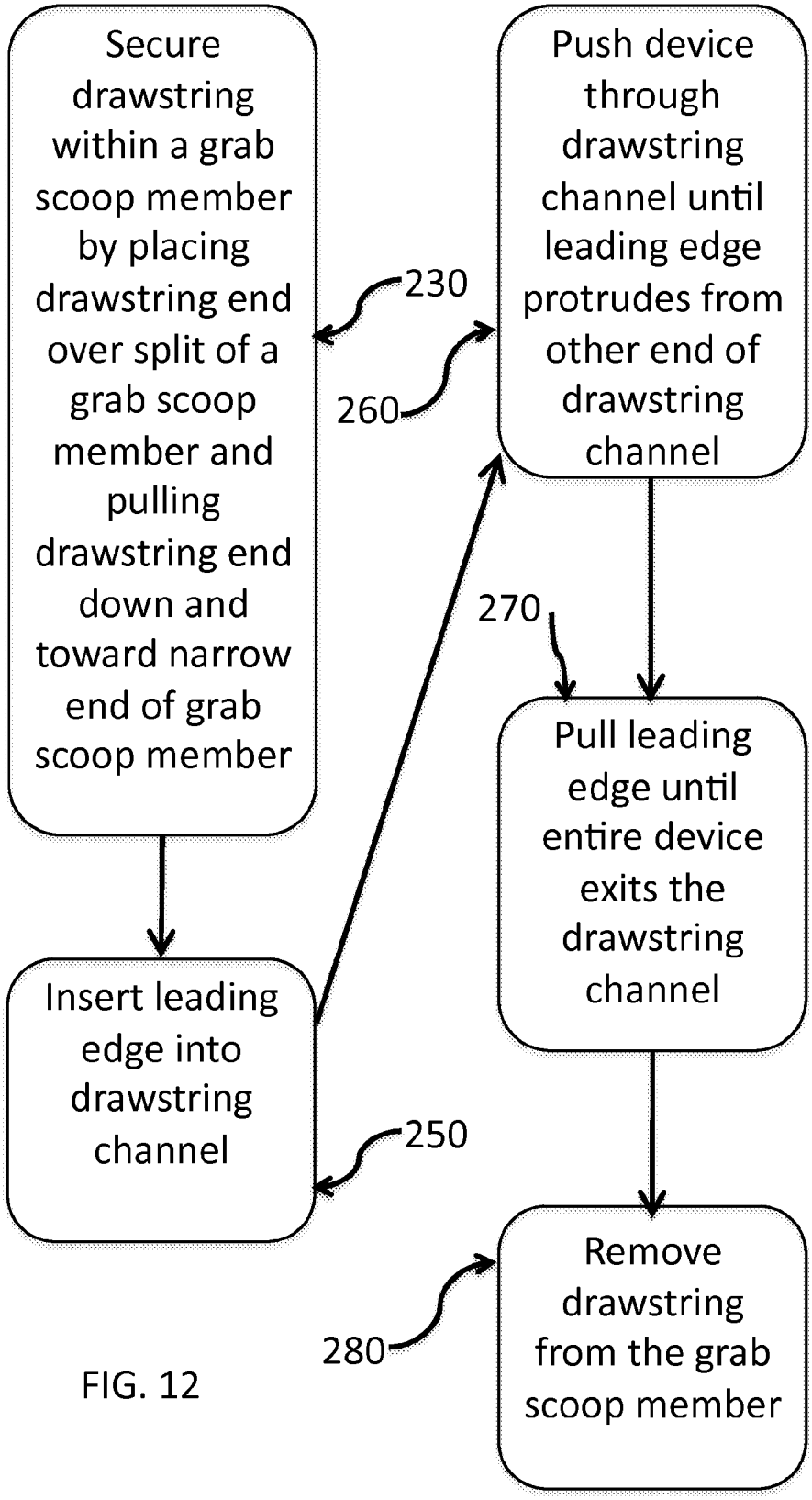
Figure 13:
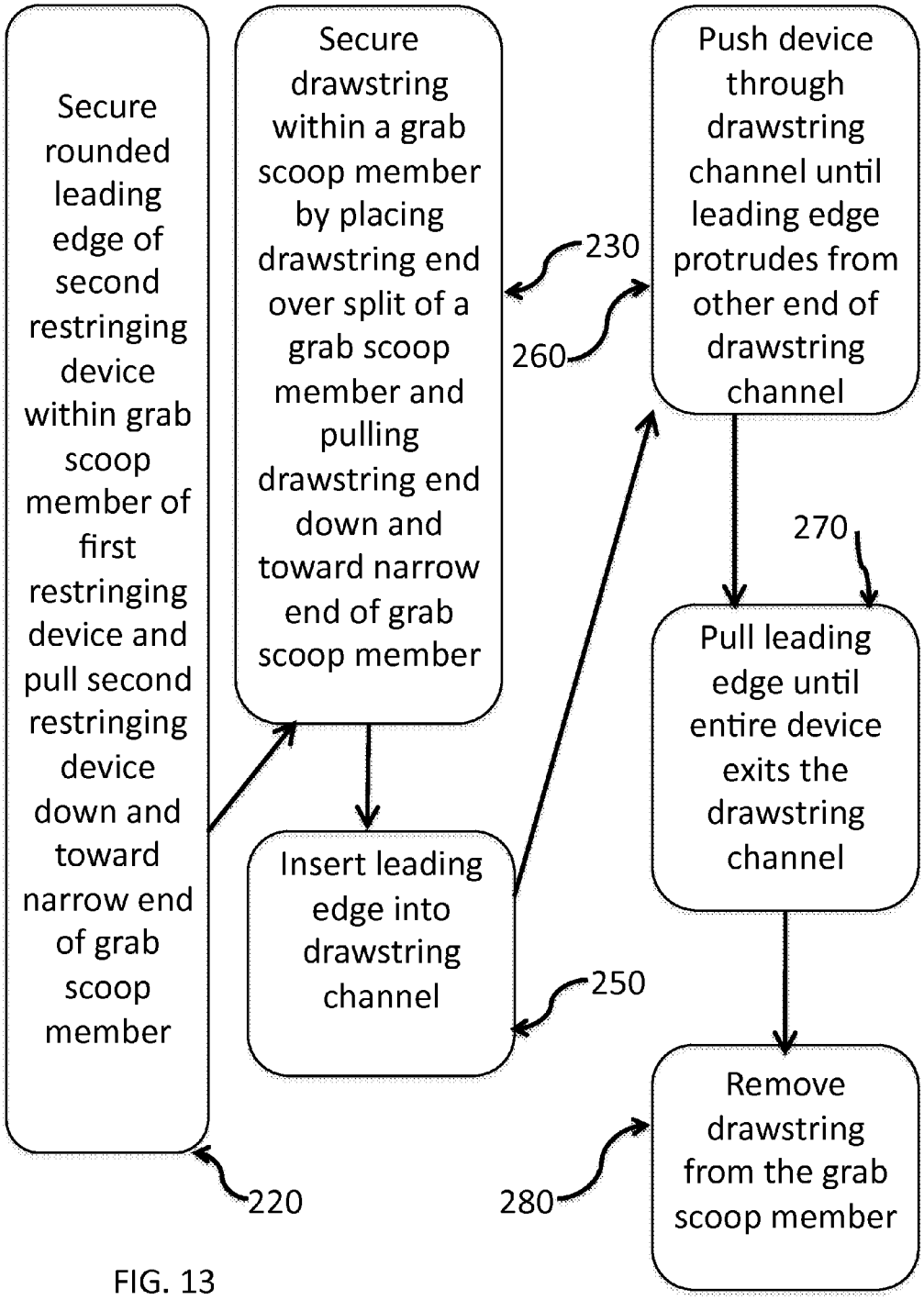
FIG. 13 depicts a method for attaching one drawstring restringing device to a second drawstring restringing device.

Referring now to FIG. 12, a method of restringing a drawstring using a drawstring restringing device is shown. First, the drawstring is secured within a grab scoop member by placing the end of a drawstring over the split of a grab scoop member and pulling the drawstring end down and toward the narrow end of the grab scoop member 230. Next, the leading edge is inserted into a drawstring channel 250. The drawstring restringing device is then pushed through the drawstring channel until the leading edge protrudes from the other end of the drawstring channel 260. Next, the leading edge is pulled until the entire device exits the drawstring channel 270. Finally, the drawstring is removed from the grab scoop member 280.

Referring now to FIG. 12, a method for connecting two drawstring restringing devices and then restringing a drawstring using the drawstring restringing devices is shown. First, the leading edge of a second restringing device is secured within the grab scoop member of the first restringing device. The second restringing device is then pulled down and toward the narrow end of a grab scoop member 220. The drawstring is next secured within a grab scoop member by placing the end of a drawstring over the split of a grab scoop member and pulling the drawstring end down and toward the narrow end of the grab scoop member 230. Next, the leading edge is inserted into a drawstring channel 250. The drawstring restringing device is then pushed through the drawstring channel until the leading edge protrudes from the other end of the drawstring channel 260. Next, the leading edge is pulled until the entire device exits the drawstring channel 270. Finally, the drawstring is removed from the grab scoop member 280.

Figure 14:
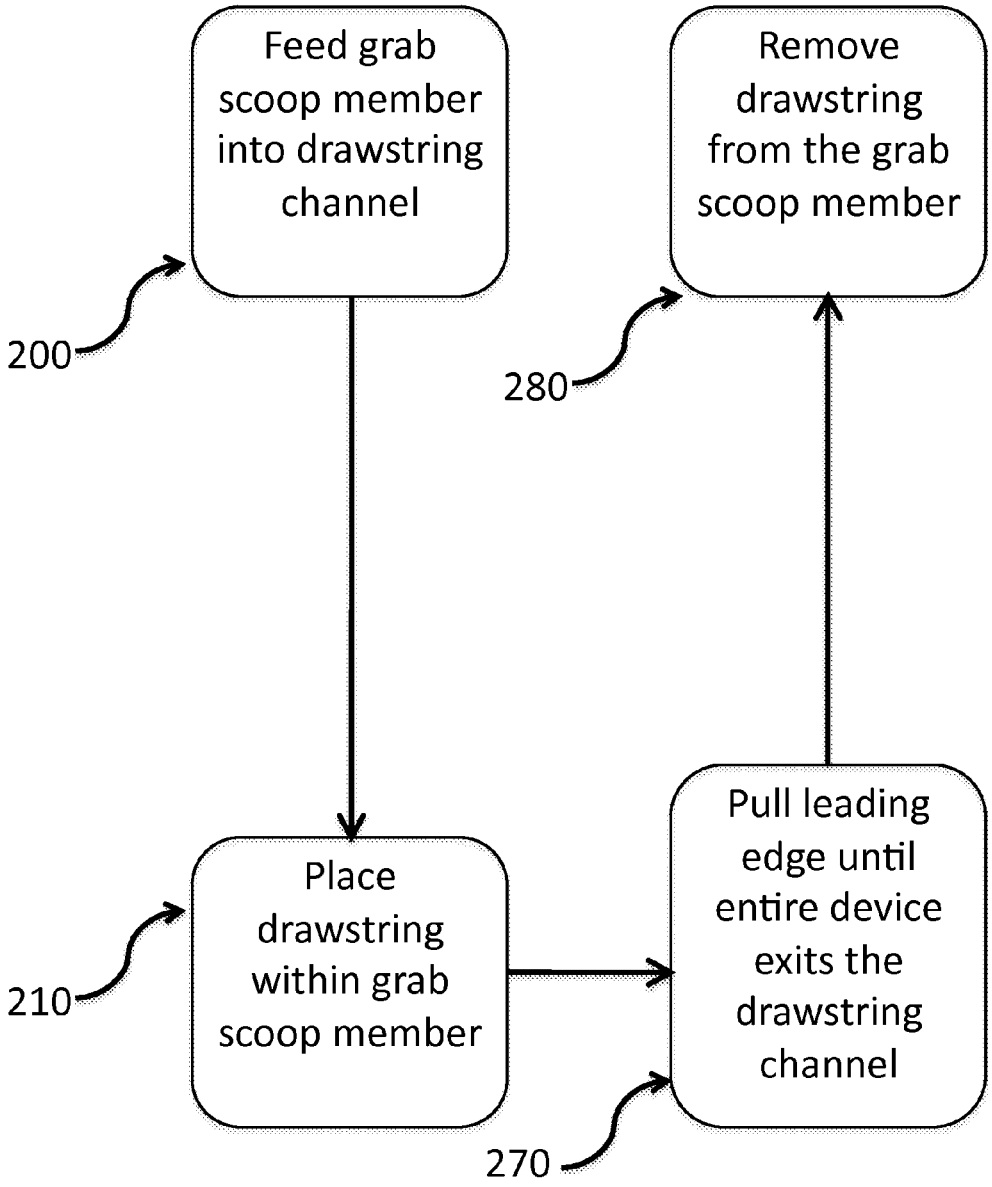
FIG. 14 depicts a method for recovering a drawstring from a drawstring channel using a drawstring restringing device.

Referring now to FIG. 14, a method for recovering a drawstring from a drawstring channel using a drawstring restringing device is shown. First, the grab scoop member is fed into the drawstring channel 200. Next, the drawstring is the placed within the grab scoop member. The leading edge is then pulled until the entire device exits the drawstring channel 270. Finally, the drawstring is removed from the grab scoop member 280.

A preferred method of manufacturing the invention may begin with creating a three dimensional CAD file of the device. Using this three dimensional CAD file, a rapid prototype may be made. This rapid prototype is likely very rigid and only useful for manufacturing purposes. A rubber or other mold may then be made from the rapid prototype. The rubber or other mold may be used to make actual prototypes by injecting heated plastic or other materials into the mold and then cooling the material until it hardens. Through the creation of various prototypes, different materials, including, but not limited to plastics may be tested to determine which material may result in the desired flexibility of the device. Once it is determined which prototype is desired, a stainless steel mold of the exact design of the device may be made from the three dimensional CAD file. Additionally, molds of different sized capacities can be made, for example, a four capacity mold will make four devices in a given time interval, an eight capacity mold will make eight devices in the same time interval, etc. Once the molds are made, the molds may then be placed within a robotic machine that allows for automated production of the finished products. To make the device, the stainless steel mold is injected with hot plastic and then cooled quickly by injecting cold water into the mold. The mold then opens and allows the product to be removed or to drop out of the mold. The mold can then be reused for as many cycles as is needed to create the desired quantity of devices.

We claim:

1. A restringing device comprising:

a substantially spherical leading edge configured to be pushed through a drawstring channel;

a flexible mid portion comprising a front end coupled to the leading edge, wherein the flexible mid portion is configured to maintain a degree of sufficient rigidity to be pushed through the drawstring channel; and a symmetrical grab scoop member comprising a split, conoid shape configured to secure a drawstring by only touching an outer surface of the drawstring, wherein the substantially spherical leading edge is configured to fit entirely within the split, conoid shape, and wherein the symmetrical grab scoop member is coupled to a back end of the flexible mid portion.

2. The device of claim 1 wherein the grab scoop member is comprised of a flexible material.

3. The device of claim 1 wherein at least one side of the grab scoop member is flexible.

4. The device of claim 1, further comprising:

a magnetic element that couples to the grab scoop member, wherein the magnetic element comprises a substantially spherical leading edge and a magnetic member.

5. The device of claim 1, further comprising:

a hooking element that couples to the grab scoop member, wherein the hooking element comprises a substantially spherical leading edge and a hooked member.

6. The device of claim 1, further comprising:

a clamp element that couples to the grab scoop member, wherein the clamp element comprises a substantially spherical leading edge and a clamp member.

7. The device of claim 6, wherein the clamp element comprises: a flexible crease;

teeth-like protrusions; and a locking mechanism configured to hold the clamp member closed.

* * * * *